US005089067A

United States Patent [19]

Schumacher

[11] Patent Number: 5,089,067

[45] Date of Patent: Feb. 18, 1992

[54] MARTENSITIC STAINLESS STEEL

[75] Inventor: William J. Schumacher, Monroe, Ohio

[73] Assignee: Armco Inc., Middletown, Ohio

[21] Appl. No.: 645,517

[22] Filed: Jan. 24, 1991

[51] Int. Cl.[5] ..... C22C 38/40

[52] U.S. Cl. ..... 148/325; 420/60

[58] Field of Search ..... 148/325; 420/60

[56] References Cited

FOREIGN PATENT DOCUMENTS 58-174554 10/1983 Japan ..... 420/60

598956 3/1978 U.S.S.R. ..... 148/325

*Primary Examiner*—Deborah Yee

*Attorney, Agent, or Firm*—Larry A. Fillnow; Robert J. Bunyard; Robert H. Johnson

[57] ABSTRACT

A substantially martensitic stainless steel as cast having good castability, ductility and capability of being hardened to a wide range of hardness, the steel consisting essentially of, in weight percent, up to about 0.08% carbon, about 1.0 to about 4.0% maganese, about 13.0 to about 17.0% chromium, about 1.5 to about 4.0% copper, up to about 0.12% nitrogen, less than about 1.0% silicon, less than about 1.0% molybdenum, less than 1.0% nickel, less than about 0.03% phosphorus, less than about 0.5% sulfur, up to about 0.005% boron, up to 0.5% niobium, vanadium, titanium and/or zirconium and balance essentially iron. The steels have particular utility in the production of cast golf clubs, forged golf clubs, cutlery, boat propellers and other cast, forged and wrought products, including free machining materials.

16 Claims, No Drawings

MARTENSITIC STAINLESS STEEL

FIELD OF THE INVENTION

The present invention relates to a novel alloy composition having controlled hardness and good casting characteristics. The alloy is useful for applications where the material is cast or forged into articles such as golf clubs and boat propellers. The alloy is also useful for wrought applications including free machining and cutlery applications.

BACKGROUND OF THE INVENTION

Martensitic stainless steels are typically in the lower range of chromium for stainless steels and therefore lower in corrosion resistance compared to the other stainless steels. Martensitic stainless steels can be heat treated to a wide range of strengths and have good machinability when sulfur is added and the steels are in the heat treated condition. Martensitic stainless steels are usually easy to heat treat and relatively easy to hot and cold work. Typically, the martensitic stainless steels are heated to a high temperature, such as 1700° to 2000° F. (930° to 1095° C.) and then air or oil quenched. A second heat treating step from 800° to 1400° F. (425° to 760° C.) tempers the martensitic stainless to the desired strength level. Martensitic stainless steels generally tend to be lowest cost of all the stainless steels.

Materials used for manufacturing golf club heads have varied considerably over the past several decades. Stainless steels, carbon steels and many other alloys have been used for golf club heads to provide the desired combination of hardness, weight, ductility, corrosion resistance, strength, toughness, abrasion resistance, wear resistance and resilience. Various alloys have also been used for the shaft of golf clubs which may have different property requirements than the heads of the golf clubs.

The alloys used for golf club heads were initially well known materials used in sand and investment foundries for casting. Other club manufacturers have chosen to go the route of forged clubs which require more finishing work. Familiarity and availability were the main reasons many of the foundries used specific stainless steel alloys rather than designing a composition for the golf head properties. Recently, club designers have experimented with new unusual alloys which were more expensive but offered specific properties, such as better feel or hardness. The properties of the various alloys for golf clubs were also modified by heat treatments to develop increased hardness or strength.

When it comes to the selection of a club material, some manufacturers have spared no expense if the club can provide added feel or distance for the golfer. More expensive alloys such as copper-beryllium, copper-tin, copper-nickel-zinc and aluminum-titanium have been used as well as surfaces having a composite structure with fibers impregnated.

Golf club heads may be forged or cast. The use of investment cast heads allows the club manufacturers to purchase detailed castings which require no or minimal finishing operations. The freedom in design is greatly increased with the use of castings. Casting tooling includes the hosel detail, scoring lines and identification as part of the mold. Forged clubs are more limited in design and require considerable finishing operations. Forging tooling is far more expensive if club design changes are required. Forged articles generally would have a higher density because of the working of the material. The amount of forging reduction has a strong influence on the metallurgical structure. Forgings may also be produced at manufacturing plants which do not have melting or casting equipment. The properties requirements for golf club heads permit either cast or forged production.

The selection of a material for a golf club head must consider many properties. The finished head weight must fall within very narrow limits to comply with specifications. The metal must be capable of withstanding the wear and impact forces associated with playing the game. The tensile strength, fracture resistance, hardness and density of a material must all be considered in selecting a material for casting.

Stainless steels are used for golf clubs because they provide the above properties and also have excellent corrosion resistance. The most common choices of stainless steels have been T304, T431 and 17-4PH. Each of these materials offers different properties.

T304 is an austenitic material having about 18% Cr, 8% Ni and less than 0.08% C. This stainless is relatively soft and can not be hardened by heat treatment. While very corrosion resistant, its use is restricted to irons having thicker hosel bases which helps to limit the amount of bending. Austenitic stainless steels, such as T304, have been used but tend to mar very easily. Often these steels were selected because scrap was available at a reasonable price. The austenitic stainless steels have a large addition of nickel which greatly increases the cost of the material. The lower strength level as cast does not allow a more streamlined golf head design to be used.

The 400 series of stainless steels has also been used to provide the desired hardness and corrosion resistance for golf clubs. However, these alloys require a suitable heat treatment and close control of chemistry to achieve the desired properties. Type 431 is commonly used and requires a double heat treatment to obtain the desired properties. The steel lacks the ductility required for adjusting the alignment of the head and the hosel. T431 is a martensitic stainless consisting of about 16% Cr, 2% Ni and less than 0.2% C. It is less corrosion resistant than T304 and is usually given a passivation treatment to clean the surface. T431 can be heat treated to provide high strength and hardness levels and is restricted for use in wedges, putters and ironheads.

The stainless steel widely used for golf clubs has been 17-4 PH (see U.S. Pat. Nos. 2,482,096; 2,482,097 and 2,482,098). It has the desired corrosion resistance and a hardness in the Rockwell C range of about 30 to 35. It can not be sofened to a significantly lower level to obtain the desired feel when striking the ball. This steel was designed originally for aircraft requirements and was not designed for the properties needed for the golfing industry. Many golf club heads have been designed using 17-4 PH steel simply because it is well known, available as remelt stock and is forgiving of minor chemistry variations. 17-4 PH is a precipitation hardenable steel having about 17% Cr, 4% Ni, 2.75% Cu and less than 0.07% C. It is the strongest and hardest of the stainless steels presently used for this application.

Some club designers have used chromium plated clubs but these tend to show corrosion when dinged.

One alloy designed specifically for the golfing industry is described in U.S. Pat. No. 4,314,863 by Jon McCormick of Fansteel Inc. (incorporated by reference).

The stainless steel casting alloy consisted of 13 to 19% chromium, 2 to 3.6% nickel, 2 to 3.5% copper, 0.20 to 1.4% manganese, 0.5 to 1.0% silicon, 0.1 to 0.8% carbon, 0.10% max nitrogen, less than 0.10% molybdenum, less than 0.10% aluminum, less than 0.10% columbium, 0.035% max sulfur, 0.035% max phosphorus and balance essentially iron. The sum of nickel and copper must be at least 5%. The stainless casting was designed to be economical, to provide the desired hardness of about Rockwell B 90 and to provide other mechanical properties without requiring any supplemental heat treatments. The preferred microstructure is substantially austenite in combination with some martensite or delta ferrite.

Another stainless steel developed for the golf club head industry is disclosed in Japanese publication J55029329. The alloy is designed to produce good vibration dampening and has a composition comprising 8-25% Cr, 0.2-3.0% Mo, 0.5-3.0% Ni, 1.0-4.0% Si, 0.06% maxC, and balance Fe. The typical alloy had about 18% Cr, 1% Mo, 1% Ni, 2.5% Si, 0.005% C and balance Fe. The main improvements in dampening were attributed to the additions of Cr and Mo.

Stainless steels are widely used in marine applications because of their excellent corrosion resistance. Alloys such as T431, 15-5 PH, and 17-4 PH are widely used for applications such as boat propellers. Marine applications also require alloys which have good ductility, strength and hardness. However, the PH alloys are over-graded for these uses and there exists a need for a more cost effective and easier to heat treat alloy.

Martensitic stainless steels have been developed for the marine industry which possess good pitting resistance and high strength. An example is Japanese publication J 01246343 which comprises up to 0.08% C, up to 3% Si, up to 3% Mn, 2.5-5.0% Cu, 2.5-6.0% Ni, 10.0-20.0% Cr, 1.5-5.0% Mo, 0.1-1.0% Nb and/or Ta, 0.005-0.050% B, 0.105-0.40% N and balance Fe. The alloy was for use as marine pumps, shafts and valves.

Another martensitic stainless for marine applications is represented by Japanese publication J 63000436. The steel comprises 0.03% max C, 0.30-0.60% Si, 0.7-1.00% Mn, 0.15-0.45% Ni, 11.5-12.5% Cr, 0.5% max Mo, 0.30-0.50% Cu, 0.060% N and balance Fe. The alloy has good welding characteristics including the capability of being welded without preheating.

None of the alloys presently used for golf clubs have the desired combination of properties to be capable of providing the complete production of all of the desired clubs and designs. Furthermore, the expense of the materials and the cost of the required heat treatments or finishing steps results in the need for a more economical alloy with the desired range of properties. The existing metals used for the manufacture of golf club heads are expensive and deficient in one or more properties and have additional processing steps required to enable its use.

SUMMARY OF THE INVENTION

The present invention comprises a substantially martensitic, as-cast, stainless steel composition which may be processed into cast, forged and wrought articles manufactured from the steel composition. The composition consists essentially of, in weight %, up to about 0.08% carbon, above 1.0% to about 4.0% manganese, about 1.0% max silicon, less than 1.0% nickel, less than 1.0% molybdenum, about 1.5 to about 4.0% copper, up to about 0.12% nitrogen, about 13.0 to about 17.0% chromium, boron up to about 0.005%, sulfur up to about 0.5%, phosphorus up to about 0.03% and balance essentially iron with normally occurring residuals.

The stainless steel composition of the present invention is particularly suited for investment cast and forged golf club heads and boat propellers as well as many other wrought, forged and cast articles. The economical cast or forged articles have a combination of properties well suited for golf clubs. These include good corrosion resistance, good ductility, the ability to be hardened within the range desired for better "feel" and good castability.

For marine applications, the alloy has excellent strength, corrosion resistance and hardness necessary for articles such as propellers for boats.

For free machining grades, the present steels are characterized by a sulfur addition up to about 0.5% and typically about 0.10% to about 0.5%.

The composition of the present invention also has very good wrought properties which include good ductility, grain size and strength.

The stainless steel of the present invention is characterized by a cast substantially martensitic structure having less than about 20% ferrite and less than about 5% retained austenite. The amount of ferrite in the final product will depend on the heat treatment selected.

An object of the present invention is to provide martensitic stainless steel castings, forged articles and wrought products which have the capability of being heat treated to a broad range of hardness.

A further object is to provide an alloy which is less costly to produce yet provides better properties than existing materials.

A still further object of the present invention is to provide a stainless composition which is balanced to provide better castability and hot working.

An advantage of the present invention is the production improvement provided by the composition balance which provides improved ductility in cast and wrought products.

A further advantage of the present invention is the reduction of cracking in the cast articles.

A still further advantage is the greater range of hardness which can be provided with the steels of the present invention to provide golf heads with better feel.

Another advantage of the steels of the present invention is the improved ductility which simplifies the manufacturing of the connection between the head and the hosel to allow the desired club angle.

The objects and advantages listed above and others will become better understood based on the detailed description of the invention.

DETAILED DESCRIPTION OF THE INVENTION

The martensitic stainless steel of the present invention was developed to provide a combination of properties particularly suited for the production of cast or forged golf club heads. The properties for which the alloy was particularly designed for included a hardness within the range of Rockwell B 95 to Rockwell C 40 or higher, good castability, good ductility, good toughness and acceptable corrosion resistance. The present alloy provides this combination of properties and is more economical than existing materials and their required processing steps for club manufacturing. The steels of the invention may be used to provide the desired combination of properties using a single heat treatment that does not require age hardening. Numerous articles may be manufactured from the stainless steel composition of the invention. These include various finished wrought product articles such as sheet, strip, bar, rod, wire, tubing and wrought semi-finished articles such as remelt stock, slabs, billets, blooms, and shaped articles. Other articles from the composition of the invention include forged, cast and powder articles. Specific articles of interest relating to the steels of the invention include cast products such as golf club heads and propellers, forged products such as golf club heads and cutlery, and stainless steel articles for freemachining applications.

The composition of the substantially martensitic stainless steel of the invention consists essentially of, in weight percent, up to about 0.08% carbon, greater than 1.0 to about 4.0% manganese, about 13.0 to about 17.0% chromium, about 1.5 to about 4.0% copper, up to about 0.12% nitrogen, less than 1.0% nickel, less than about 1.0% silicon, less than about 1.0% molybdenum, sulfur up to about 0.5% and balance essentially iron. The steels will have the normally occurring residual elements present from the melting practice. These will include phosphorus up to about 0.03% and other residual elements. A small addition of boron up to about 0.005% may be made. Sulfur may be added up to about 0.5% and preferably about 0.1 to about 0.5% for free machining applications. Sulfur will normally be below about 0.03% when machinability is not important. Niobium, titanium, vanadium and or zirconium may be added in amounts up to about 0.3% for grain refinement and improved ductility.

A preferred composition of the steel of the invention consists essentially of, in weight %, about 0.03 to about 0.07 % carbon, about 1.5 to about 3.5% manganese, about 14 to about 16% chromium, about 2 to about 3.5% copper, about 0.04 to about 0.12% nitrogen, less than about 0.9% and more preferably less than about 0.75% nickel, about 0.001 to about 0.003% boron, and balance essentially iron. Any of the preferred ranges for the elements may be used with the broad ranges for the remaining elements.

A more preferred range of the steels of the invention for the golf club market consists essentially of, in weight %, about 0.03 to about 0.06% carbon, about 1.75 to about 2.5% manganese, about 14.5 to about 15.5% chromium, about 2.5 to about 3.25% copper, about 0.06 to about 0.09% nitrogen, about 0.5% max nickel, about 0.75% max silicon, about 0.5% max molybdenum, about 0.025% max phosphorus, about 0.02% max sulfur, about 0.001 to about 0.003% boron and balance essentially iron. Any of the more preferred ranges of elements may be used with the broader ranges of the remaining elements.

The carbon content of the stainless steel composition is maintained below about 0.08% to provide good corrosion resistance, good ductility, good castability and the desired hardness. With the carbon maintained at these low levels, the alloy may be properly balanced with the present chromium levels to produce the desired martensitic structure. The lower chromium levels provide the desired corrosion resistance and help make the alloy more economical to produce. The preferred carbon levels of about 0.03 to about 0.07% and more preferably from about 0.03% to about 0.06%, contribute to the desired combination of properties. This carbon content is a departure from many of the stainless steel alloys designed for the golfing industry, such as taught in U.S. Pat. No. 4,314,863, wherein the carbon is maintained above 0.2% and typically about 0.2 to 0.5%. The present alloy avoids the presence of excessive carbides which lower corrosion resistance, reduce ductility, lower notch toughness and make machining more difficult. The high level of carbon in this reference was required to achieve the desired as-cast hardness.

The nitrogen levels present in the steels of the invention are balanced with the carbon content to provide the desired martensitic structure as cast. A nitrogen content up to about 0.12% may be used. A preferred range of about 0.04 to about 0.12% and more preferably about 0.06 to about 0.09% provides a more controlled balance of the desired properties. Like carbon, the nitrogen adds to the hardness of the alloy, permits a lower nickel content without lowering the corrosion resistance to any significant degree and reduces the cost of the alloy.

The manganese content of the present steel is typically about 1.0 to about 4.0% and preferably about 1.5 to about 3.5% for the preferred properties. Optimum contents range from about 1.75 to about 3.0%. The manganese helps to substitute for nickel up to about 2% and acts as an austenite stabilizing addition above about 2%. Manganese acts as a deoxidizer during refining and tends to combine with any sulfur present to form chromium rich manganese sulfides. This form of sulfides is favorable over other sulfide forms for good corrosion resistance and machinability.

The chromium content of the steels of the invention is in the range of about 13 to about 17% and preferably about 14 to about 16%. The chromium content is balanced with austenite forming elements to provide the desired martensitic structure. This balance provides the desired corrosion resistance and hardness as well. Chromium is preferably maintained at as low a level as possible to meet the desired properties and keep the alloy economical. The optimum chromium is about 14.5 to about 15.5%.

Copper is an essential addition to the steels of the invention to permit the reduction in nickel content and stabilize a portion of the austenite. The present copper level does not require the nickel relationship of U.S. Pat. No. 4,314,863 wherein the sum of the nickel and copper must be at least about 5% and a copper range of about 2.0 to 3.5% is present to provide the desired as-cast hardness. The copper content of the present invention is from about 1.5 to about 4.0% and preferably about 2.0 to about 3.5% but does not have the same relationship with nickel. The optimum combination of properties is provided when the copper ranges from about 2.5 to about 3.25%. Copper additions in the upper part of the range, such as about 3.0 to about 4.0% may be used to provide the softest material within the ranges of the invention. With proper heat treatment, the well known age hardening effects of copper may be utilized.

Nickel is restricted to levels below 1.0% to reduce the alloy cost of the material. Preferably, the nickel is below about 0.9% and more preferably below about 0.75% and still more preferably below 0.5%. Nickel is replaced by additions of carbon, nitrogen, copper and manganese in the present composition. The nickel present does contribute to the hardness, austenite, and notch toughness of the alloy.

Silicon is present in the steel in an amount ranging up to about 1.0%. Preferably silicon is present at a level below about 0.75%. Silicon acts as a deoxidizer during refining and tends to improve the fluidity and castability of the molten metal. Higher levels of silicon would require additions of austenite forming elements to balance the structure which tends to increase the cost of the alloy and does not appear to provide any substantial benefits. Silicon contents above about 1.0% may tend to cause low ductility in any ferrite present which contributes to fracture.

Molybdenum is present in an amount up to about 1.0% and preferably is maintained at residual levels up to about 0.75%. A more preferable range is to maintain the molybdeum below about 0.5%. When the alloy is used for marine applications, it may be preferable to maintain the molybdenum nearer the upper limits of the ranges for improved corrosion resistance.

Boron is optional in the present alloy system but does seem to provide some benefits for improved hot working. When present, boron should be in the range of about 0.001 to about 0.003%.

Sulfur is maintained at levels below about 0.03% and typically at levels below about 0.02% for improved corrosion resistance. In some situations, sulfur could range as high as about 0.5% if better machinability were needed. A preferred range for sulfur in free-machining applications is about 0.1 to about 0.5%.

Phosphorus is maintained at levels below about 0.03% and preferably below about 0.025%.

An optional addition is the use of niobium, titanium, vanadium and/or zirconium for improved ductility in amounts up to about 0.5% to provide improved grain refinement in wrought products. It has been determined to have very little value in castings and tends to increase the cost of the alloy.

Boat propellers are typically cast from stainless steels such as 15-5 PH, 17-PH and T 431 and require good corrosion resistance including corrosion fatigue resistance, a hardness of about Rockwell C 25 to about C 35 and good machinability. The present alloy is particularly well suited for marine articles such as boat propellers.

Various wrought products such as sheet, strip, bar, rod, wire, billets, blooms and slabs may be produced from the steels of the present invention. These martensitic steel articles possess the excellent combination of properties of the invention also. Forgings, including forged golf club heads and cutlery applications, may also be manufactured from the steels of the invention.

The data in Table 1 below reports the various compositions studied during the investigations of the present invention. The materials were air induction melted and represent typical remelt stock used for investment casting.

TABLE 1

| | Chemical Analysis of Materials (Weight %) | | | | | | | | | | |
|---|---|---|---|---|---|---|---|---|---|---|---|
| Steel | C | Mn | P | S | Si | Cr | Ni | Cu | N | Cb | B |
| A1* | .041 | 2.16 | .018 | .007 | .76 | 14.77 | <.1 | 2.83 | .074 | | |
| A2* | .042 | 2.13 | .018 | .007 | .76 | 15.09 | <.1 | 2.82 | .087 | | |
| A3* | .042 | 2.15 | .017 | .008 | .79 | 15.31 | <.1 | 2.82 | .090 | | |
| B1* | .040 | 4.14 | .018 | .007 | .89 | 14.98 | <.1 | 2.80 | .072 | | |
| B2* | .041 | 4.12 | .017 | .006 | .91 | 15.22 | <.1 | 2.79 | .086 | | |
| B3* | .040 | 4.12 | .018 | .006 | .94 | 15.39 | <.1 | 2.80 | .100 | | |
| C1* | .040 | 1.99 | .022 | .013 | .64 | 15.11 | <.1 | 3.10 | .085 | .15 | .001 |
| C2* | .036 | 1.94 | .022 | .008 | .65 | 15.08 | <.1 | 3.11 | .084 | .21 | .002 |
| C3* | .035 | 1.92 | .022 | .006 | .67 | 15.12 | <.1 | 3.11 | .084 | .30 | .002 |
| D1* | .036 | 2.12 | .022 | .008 | .66 | 15.07 | 1.00 | 3.13 | .089 | .15 | .002 |
| D2* | .036 | 2.08 | .022 | .008 | .66 | 15.10 | 1.01 | 3.13 | .089 | .22 | .002 |
| D3* | .036 | 2.02 | .021 | .008 | .64 | 15.10 | 1.00 | 3.12 | .090 | .30 | .001 |
| E* | .061 | 2.04 | .020 | .008 | .78 | 15.24 | 0.52 | 3.19 | 0.092 | | |
| F1* | .039 | 2.21 | .024 | .003 | .68 | 15.26 | 1.01 | 3.11 | .056 | | |
| F2* | .038 | 3.11 | .025 | .003 | .64 | 15.25 | 1.00 | 3.07 | .057 | | |
| F3* | .039 | 3.68 | .024 | .003 | .63 | 15.16 | 1.00 | 3.06 | .056 | | |
| T431 | .13 | 0.64 | .017 | .008 | .52 | 16.15 | 2.04 | 0.14 | .049 | | |
| 17-4PH | .038 | 0.54 | .017 | .008 | .55 | 16.21 | 4.13 | 3.11 | .045 | | |

*Steels of the Invention

TABLE 1A

| | | Chemical Analyses of Golf Irons (Weight %) | | | | | | | | |
|---|---|---|---|---|---|---|---|---|---|---|
| Steel | Alloy Type | C | Mn | P | S | Si | Cr | Ni | Cu | Cb |
| G | 431 | .096 | 0.92 | .028 | .009 | .098 | 15.16 | 1.54 | .14 | .23 |
| H | 431 | .126 | 0.67 | .023 | .008 | 1.16 | 16.12 | 1.56 | .20 | .065 |
| I | | .121 | 1.11 | .030 | .006 | 1.41 | 16.33 | 4.26 | .22 | .23 |
| J | 304 | .082 | 1.30 | .040 | .006 | 0.76 | 17.85 | 8.66 | .99 | — |
| K | 431 | .090 | 0.50 | .019 | .079 | 0.68 | 14.81 | 1.51 | .18 | .015 |

All steels had residual nitrogens

Steel E of the invention from Table 1 was evaluated for mechanical properties and the results are shown in Table 2. the cast tensile specimens were tested in the as-cast condition and after softening at 1300° F. (705° C.) for 1 hour with air cooling. Data on 17-4 PH was included for comparison purposes. Both alloys exhibited limited ductility in the as-cast condition. The 1300° F. (705° C.) treatment provided a good combination of strength and ductility. Modified heat treatments were conducted for hardness testing and the results are shown in Table 3. All the heat treatments for Table 2 and Table 3 were for 1 hour and air cooled except where noted. Duplicate samples of Steel E were tested.

TABLE 2

| | Mechanical Properties | | | | |
|---|---|---|---|---|---|
| Steel | UTS (ksi) | .2% YS (ksi) | % El. (2") | % RA | Rockwell Hardness |
| E-As-Cast | 165.5 | 115.7 | O.G. | 2.5 | C39.5 |
| E-As-Cast | 150.0 | 109.9 | 2.2 | 2.4 | C40.3 |
| 1300° F.-1 Hr. | 119.9 | 96.4 | 12.1 | 38.7 | C25.5 |
| 1300° F.-1 Hr. | 122.1 | 96.8 | 15.8 | 45.8 | C24.5 |

TABLE 2-continued

| Steel | Mechanical Properties UTS (ksi) | .2% YS (ksi) | % El. (2") | % RA | Rockwell Hardness |
|---|---|---|---|---|---|
| 17-4 PH As-Cast | 135 | 128 | 1 | 6 | C32 |

O.G. - Broke out of gage length

TABLE 3

| Condition | Effect of Heat Treatment on Hardness A1 | A2 | A3 | B1 | B2 | B3 | Type 431 | 17-4 PH |
|---|---|---|---|---|---|---|---|---|
| Cast STEEL E | 35 | 36 | 38 | 37 | 36 | 36 | 44 | 36 |
| Cast + 1150° F. (620° C.) | — | — | — | — | — | — | — | 30 |
| Cast + 1200° F. (650° C.) | 25 | 26 | 26 | 28 | 27 | 29 | — | 29 |
| Cast + 1250° F. (675° C.) | 24 | 23 | 25 | 26 | 27 | 28 | — | 31 |
| Cast + 1300° F. (705° C.) | 22 | 22 | 23 | 26 | 26 | 28 | — | 32 |
| Cast + 1900° F. (1040° C.) | 38 | 40 | 40 | 38 | 39 | 39 | — | 36 |
| Cast + 1900° F. (1040° C.) + 1350° F. (730° C.) | 21 | 22 | 22 | 26 | 26 | 28 | — | 31 |
| Cast + 1800° F. - .5 Hr | — | — | — | — | — | — | 25 | — |
| Cast + 1350° F. (730° C.) | — | B98 | — | — | — | — | — | — |
| Cast + 1400° F. (760° C.) | — | B97 | — | — | — | — | — | — |
| Cast + 1450° F. (785° C.) | — | B98 | — | — | — | — | — | — |
| Cast + 1500° F. (815° C.) | — | 25 | — | — | — | — | — | — |

All values were Rockwell C except where noted.

The results of the hardness tests shown in Table 3 clearly indicate the present steels of the invention may hardened to a wide range of values from B 97 to C 40 as desired. To soften the alloy by increasing the level of ferrite is easily obtained with the martensitic steels of the invention.

One of the properties of interest for the steels of the invention is ductility. To evaluate this property with steels treated at different temperatures, a series of investigations was conducted and reported in Table 4. Various steels were heat treated at temperatures from 1050° F. to 1500° F. (565° C. to 815° C.) to determine the ductility as measured by bend tests. The thickness of the materials were 0.1 inches (0.25 cm) and the ratios were determined by dividing the bend diameter by the specimen thickness. Material having no cracks was identified with a P for passing and when cracks were observed, with an F for failing. The results indicate that the steels of the invention possess good ductility when the appropriate heat treatment for the desired properties is selected.

TABLE 4

| Steel | Bend Test Results 1050° F. | 1100° F. | 1150° F. | 1200° F. | 1250° F. | 1300° F. | 1350° F. | 1400° F. | 1450° F. | 1500° F. |
|---|---|---|---|---|---|---|---|---|---|---|
| A1 | $R_C31$<br>F-4T | $R_C28$<br>F-4T | $R_C26$<br>P-4T | $R_C23$<br>P-4T | | $R_C22$<br>P/F-3T<br>P-5T | | | | |
| A2 | | | | | | $R_C22$<br>F-3T<br>P-4T<br>P-5T | $R_B98$<br>P-4T<br>P-5T | $R_B97$<br>P-4T<br>P-5T | $R_B98$<br>P-4T<br>P-5T | $R_C25$<br>F-5T<br>F-6T |
| A3 | | | | | | $R_C23$<br>F-3T<br>P-4T<br>P-5T | | | | |
| B1 | | | | | | $R_C26$<br>F-3T<br>P-4T<br>P-5T | | | | |
| B2 | | | | | | $R_C26$<br>F-3T<br>F-4T<br>P-5T | | | | |
| B3 | | | | | | $R_C28$<br>F-3T<br>F-4T<br>P-5T | | | | |
| C1 | | | $R_C29$<br>F-4T<br>F-5T | $R_C27$<br>F-4T<br>F-5T | $R_C25$<br>F-4T<br>F-5T | $R_C23$<br>F-4T<br>P-5T | | | | |
| C2 | | | $R_C28$<br>F-4T<br>F-5T | $R_C26$<br>F-4T<br>F-5T | $R_C24$<br>F-4T<br>F-5T | $R_C21$<br>F-4T<br>P-5T | | | | |
| C3 | | | $R_C27$<br>F-4T<br>F-5T | $R_C25$<br>F-4T<br>F-5T | $R_C23$<br>F-4T<br>F-5T | $R_B97$<br>F-4T<br>P-5T | | | | |
| D1 | | | $R_C34$<br>F-4T<br>F-5T | $R_C32$<br>F-4T<br>F-5T | $R_C30$<br>F-4T<br>F-5T | $R_C27$<br>F-4T<br>F-5T | | | | |
| D2 | | | $R_C34$<br>F-4T<br>F-5T | $R_C32$<br>F-4T<br>F-5T | $R_C30$<br>F-4T<br>F-5T | $R_C27$<br>F-4T<br>F-5T | | | | |
| D3 | | | $R_C34$<br>F-4T | $R_C32$<br>F-4T | $R_C29$<br>F-4T | $R_C27$<br>F-4T | | | | |

TABLE 4-continued

| | Bend Test Results | | | | | | | | | |
|---|---|---|---|---|---|---|---|---|---|---|
| Steel | 1050° F. | 1100° F. | 1150° F. | 1200° F. | 1250° F. | 1300° F. | 1350° F. | 1400° F. | 1450° F. | 1500° F. |
| | | | F-5T | F-5T | F-5T | F-5T | | | | |

T431 - 1800° F. - ½ hour RC 25 F-3T; P-4T; P5T
17-4 PH - 1300° F. - 1 hour RC32 F-3T; F-4T; P/F-5T
17-4 PH - 1150° F. - 4 hours RC30 F-3T; P-4T; P-5T The stainless steel composition and articles made from the composition of the present invention have produced a combination of properties not previously available with an economical balance of elements. The alloy balance is easily heat treated to provide a broad range of properties to suit many applications. Additions to the basic alloy composition which do not significantly influence the basic properties of the steel are considered to be within the broader aspects of the invention. A broad range of heat treatments are also considered within the teachings of the present disclosure which may be selected depending on the desired properties.

While the present invention has been described in terms of the stainless steel composition and the production of various cast, forged or wrought articles, the steels and articles have a good combination of properties suited for many other applications. It will be understood that various modifications can be made to the invention without departing from the spirit and scope of it.

I claim:

1. A substantially martensitic stainless steel composition consisting essentially of, by weight percent, up to about 0.08% carbon, about 1% to 4% manganese, about 13.0% to about 17% chromium, about 1.5% to 4.0% copper, about 0.04% up to about 0.12% nitrogen, less than about 1.0% silicon, less than about 1.0% molybdenum, less than 1.0% nickel, less than about 0.03% phosphorus, less than about 0.5% sulfur, up to about 0.005% boron, and balance essentially iron.

2. The stainless steel composition of claim 1 having about 0.03% to 0.07% carbon, about 1.5% to about 3.5% manganese, about 14.0% to about 16.0% chromium, and about 2.0% to about 3.5% copper.

3. The stainless steel composition according to claim 2 having about 1.75% to about 3.0% manganese, about 0.03% to about 0.06% carbon, about 0.06% to about 0.09% nitrogen, and about 2.5% to about 3.25% copper.

4. The stainless steel composition according to claim 1 wherein said silicon is less than about 0.75%, said nickel is less than about 0.5%, said molybdenum is less than about 0.5%, said boron is less than about 0.003%, said phosphorus is less than about 0.025%, and said sulfur is less than about 0.030%.

5. The stainless steel composition of claim 1 having up to about 0.5% niobium, titanium, vanadium, and/or zirconium.

6. A substantially martensitic stainless steel article having a hardness on the Rockwell scale of about B 95 to C 40 or higher and consisting essentially of, in weight percent, up to about 0.08% carbon, about 1.0% to about 4.0% manganese, about 13.0% to about 17.0% chromium, about 1.5% to about 4.0% copper, about 0.04% up to about 0.12% nitrogen, less than about 1.0% silicon, less than about 1.0% molybdenum, less than about 1.0% nickel, less than about 0.03% phosphorus, less than about 0.5% sulfur, up to about 0.005% boron, and balance essentially iron.

7. The steel article of claim 6 wherein said article includes sheet, strip, bar, rod, wire, tubing, remelt stock, shaped, forged, cast, and powder articles.

8. The martensitic stainless steel article of claim 6 having about 0.03% to about 0.07% carbon, about 1.5% to about 3.5% manganese, about 14.0% to about 16.0% chromium, and about 2.0% to about 3.5% copper.

9. The steel article of claim 6 having about 1.75% to about 3.0% manganese, about 0.03% to about 0.06% carbon, about 0.06% to about 0.09% nitrogen, and about 2.5% to about 3.25% copper.

10. The steel article of claim 6 wherein said silicon is less than about 0.75%, said nickel is less than about 0.5%, said molybdenum is less than about 0.5%, said boron is less than about 0.003%, said phosphorus is less than about 0.025%, and said sulfur is less than about 0.03%.

11. A stainless steel golf club head which is substantially martensitic having a hardness in the Rockwell range of B95 to about C40 or higher, said golf club head consisting essentially of, in weight percent, up to about 0.08% carbon, about 1.0% to about 4.0% manganese, about 13.0% to about 17.0% chromium, about 1.5% to about 4.0% copper, up to about 0.12% nitrogen, less than about 1.0% silicon, less than about 1.0% molybdenum, less than 1.0% nickel, less than about 0.03% phosphorus, less than about 0.03% sulfur, up to about 0.005% boron, and balance essentially iron.

12. A free machining substantially martensitic stainless steel compostion consisting essentially of, in weight percent, up to about 0.08% carbon, about 1.0% to about 4.0% manganese, about 13.0% to about 17.0% chromium, about 1.5% to about 4.0% copper, about 0.04% up to about 0.12% nitrogen, less than about 1.0% silicon, less than about 1.0% molybdenum, less than 1.0% nickel, less than about 0.03% phosphorus, about 0.1% up to about 0.5% sulfur, up to about 0.005% boron, and balance essentially iron.

13. The free machining stainless steel composition of claim 12 having about 0.03% to 0.07% carbon, about 1.5% to about 3.5% manganese, about 14.0% to about 16.0% chromium, and about 2.0% to 3.5% copper.

14. The free machining stainless steel composition of claim 13 having about 1.75% to about 3.0% manganese, about 0.03% to about 0.06% carbon, about 0.06% to about 0.09% nitrogen, and about 2.5% to about 3.25% copper.

15. The stainless golf club head of claim 11 consisting essentially of, in weight %, about 0.03% to about 0.07% carbon, about 1.5% to about 3.5% manganese, about 14.0% to about 16.0% chromium, about 2.0% to about 3.5% copper, and about 0.04% to about 0.12% nitrogen.

16. The stainless golf club head of claim 11 consisting essentially of, in weight %, about 0.03% to about 0.06% carbon, about 1.75% to about 2.5% manganese, about 14.5% to about 15.5% chromium, about 2.5% to about 3.25% copper, about 0.06% to about 0.09% nitrogen, about 0.5% max nickel, about 0.75% max silicon, about 0.5% max molybdenum, about 0.025% max phosphorus, about 0.001% to about 0.003% boron, and balance essentially iron.

* * * * *